United States Patent [19]

Lavering

[11] Patent Number: 4,620,170

[45] Date of Patent: Oct. 28, 1986

[54] MEANS FOR LIQUID COOLING A MICROWAVE WINDOW

[75] Inventor: Gordon R. Lavering, Belmont, Calif.

[73] Assignee: Varian Associates, Inc., Palo Alto, Calif.

[21] Appl. No.: 683,756

[22] Filed: Dec. 19, 1984

[51] Int. Cl.[4] ..... H01P 1/08

[52] U.S. Cl. ..... 333/252; 315/4; 315/39.53

[58] Field of Search ..... 333/252, 254, 248, 22 F; 315/4, 5, 39.53

[56] References Cited

U.S. PATENT DOCUMENTS

| | | | |
|---|---|---|---|
| 2,990,526 | 6/1961 | Shelton, Jr. | 333/252 |
| 3,085,213 | 4/1963 | Walker | 315/39 |
| 3,096,462 | 7/1963 | Feinstein | 315/39.53 |
| 3,255,377 | 6/1966 | Sylvernal | 315/39.75 |
| 3,275,957 | 9/1966 | Pickering et al. | 333/252 |
| 3,308,332 | 3/1967 | Bibb | 315/5 |
| 3,324,427 | 6/1967 | Weiss | 333/252 |
| 3,339,102 | 8/1967 | Johnson | 315/3 |
| 3,594,667 | 7/1971 | Mann | 333/252 |
| 4,286,240 | 8/1981 | Shively et al. | 333/252 |
| 4,371,854 | 2/1983 | Cohn et al. | 333/252 |

*Primary Examiner*—Eugene R. LaRoche
*Assistant Examiner*—Benny T. Lee

[57] ABSTRACT

A novel window assembly with improved cooling capabilities for use in high power microwave tube and waveguide apparatus is disclosed. A septum with a circular central aperture is disposed between two parallel windows. Cooling fluid is circulated in from the periphery of one of said windows, flows toward the central region, through the aperture in the septum, and then out at the periphery of the second of said windows. This arrangement results in an increased cooling fluid velocity thereby increasing the cooling effectiveness of the window assembly. By adding surface features such as bumps, channels and the like to the septum, one can additionally increase local cooling fluid velocity in areas of the window assembly subject to greater localized heating. This is particularly useful in gyrotron tubes, where the energy impinging on the window surface is in the circular-electric-field mode and areas of the window surface are known to be subject to greater thermal stress.

14 Claims, 8 Drawing Figures

MEANS FOR LIQUID COOLING A MICROWAVE WINDOW

FIELD OF THE INVENTION

This invention relates to high power microwave transmission. A microwave window is often needed to get the power into or out of a vacuum chamber device, such as an electron tube, plasma chamber or a pressurized section of a waveguide.

BACKGROUND OF THE INVENTION

Microwave windows are used for passing energy between an evacuated section, such as an electron tube output and a gas-filled waveguide section. In the past, such windows have generally been made of a single piece of glass or ceramic sealed across the hollow cross section of the waveguide. See U.S. Pat. No. 3,255,377 and U.S. Pat. No. 3,096,462, both co-assigned with the present invention, for single piece windows of the prior art. Despite careful selection of materials with optimal thermal and mechanical characteristics, and the utilization of shapes and dimensions designed to minimize energy absorption, single piece windows are limited in their ability to handle high power transmission due to heat absorption.

One approach to increasing the power capacity of microwave windows has been to provide cooling means for absorbing the thermal energy imparted to the window. Examples of this approach are disclosed in U.S. Pat. No. 4,286,240 and U.S. Pat. No. 4,371,854, both co-assigned with the present invention. These patents disclose windows comprising two parallel window plates, narrowly separated, with means for circulating a cooling fluid between the plates.

While fluid cooled windows are now commonly employed in microwave tubes, removing heat from the window remains a problem with modern high power tube designs. A particular problem is related to the fact that microwave radiation patterns can cause localized heating or "hot spots" on the window surface beyond the capacity of the structure to provide cooling. When the radiation is of the circular electric field mode, these hot spots tend to occur in an annular band between the central and peripheral regions of the window.

SUMMARY OF THE INVENTION

Accordingly, an object of the present invention is to provide improved means for cooling microwave window assemblies, thereby increasing the ability to transmit high power, high frequency electromagnetic radiation between components operating at different pressure levels.

A further object of this invention is to provide means for increasing the localized fluid velocity of a cooling fluid circulated between two window plates of a microwave window assembly, thereby mitigating the problem of hot spots on the surface of said plates.

The foregoing objectives are achieved by utilizing a window assembly comprised of two parallel window plates, with a dielectric septum having a central aperture disposed between the plates and parallel thereto. Cooling fluid is circulated into the space between the first plate and the septum around the periphery of the window, flows radially inward toward the central aperture of the septum, through the aperture and then radially outward between the septum and the second window plate where it is collected at the periphery. The septum can be constructed to have raised surfaces to create a localized velocity increase and to impart a rotational component to the fluid flow, thereby further improving the heat removal capacity of the window assembly.

DESCRIPTION OF THE PREFERRED EMBODIMENTS

Figure 1:
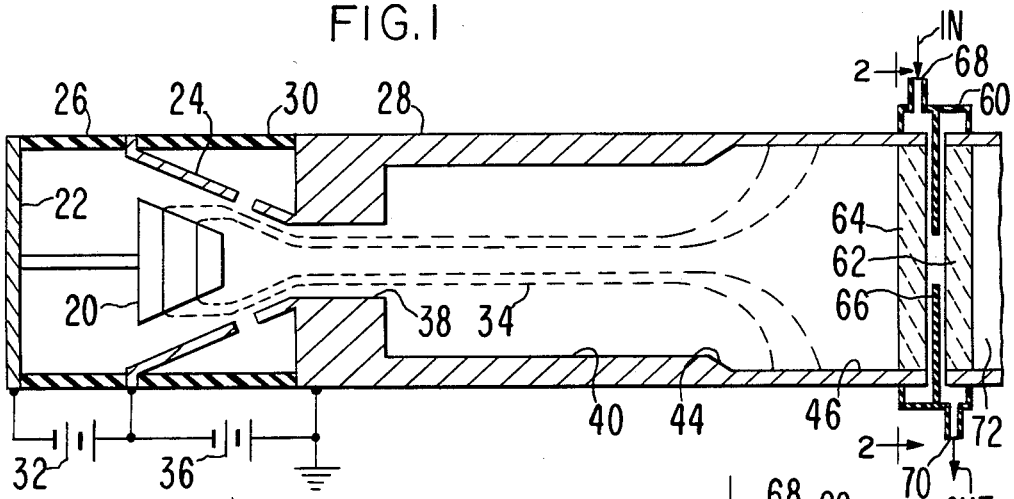
FIG. 1 is a cross-section schematic diagram of a gyrotron tube with an output window embodying the present invention.

FIG. 1 shows a single cavity gyrotron oscillator with an output window according to the present invention. Gyrotrons are often used in the high power, high frequency applications requiring improved window designs necessary to overcome heating problems. The microwave radiation of a gyrotron is customarily in the circular mode.

In the gyrotron of FIG. 1, a thermionic cathode 20 is supported on an end plate 22 of the vacuum envelop. End plate 22 is sealed to the accelerating anode 24 by a dielectric envelope member 26. Anode 24 in turn is sealed to the main tube body 28 by a second dielectric member 30. In operation, cathode 20 is held at a potential negative to anode 24 by a power supply 32. Cathode 20 is heated by an internal radiant heater (not shown). Thermionic electrons are drawn from the conical emitting surface of the cathode by the attraction of the coaxial conical anode 24. The entire structure is immersed in an axial magnetic field H produced by a surrounding solenoid magnet (not shown). The initial radial motion of the electrons is converted by the crossed electric and magnetic fields to a motion away from cathode 20 and spiralling about the axis, forming a hollow spiral beam 34. Anode 24 is held at a potential negative to tube body 28 by a second power supply 36, giving further axial acceleration to the beam 34. In the region between cathode 20 and body 28, the strength of the magnetic field is increased greatly, causing beam 34 to be compressed in diameter and also increasing its rotational energy at the expense of axial energy. The rotational energy is the part involved in the useful interaction with the circuit wave field. The axial energy merely provides beam transport through the interacting region. Beam 34 passes through a drift tube 38 into the interaction cavity 40 which is resonant at the operating frequency in the $TE_{0ml}$ mode. In this example, it is $TE_{021}$. The magnetic field strength H is adjusted so that the cyclotron frequency rotary motion of the electrons is approximately synchronous with the cavity resonance. The interaction produces a phase bunching of beam 34, that is, the electrons' rotary motions are synchronized. They can then deliver rotational energy to the circular electric field, setting up a sustained oscillation.

At the output end of cavity 40 an outwardly tapered section 44 couples the output energy into a uniform waveguide 46 which has a greater diameter than resonant cavity 40 in order to propagate a travelling wave. Near the output of cavity 40 the magnetic field H is reduced. Beam 34 thus expands in diameter under the influence of the expanding magnetic field lines and its own self-repelling space charge. Beam 34 is then collected on the inner wall of waveguide 46 which also serves as a beam collector. The microwave radiation then exits the vacuum envelop through the window 60 to a gas-filled waveguide section 72.

Figure 2:
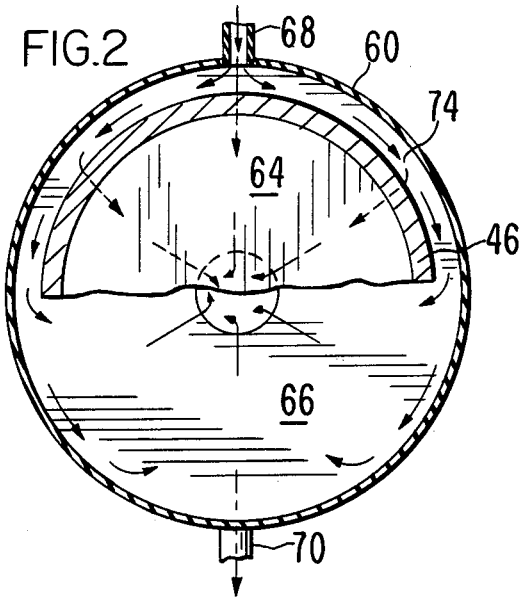
FIG. 2 is a view of the window assembly along view lines 2 looking perpendicular to the window face.
Figure 3:
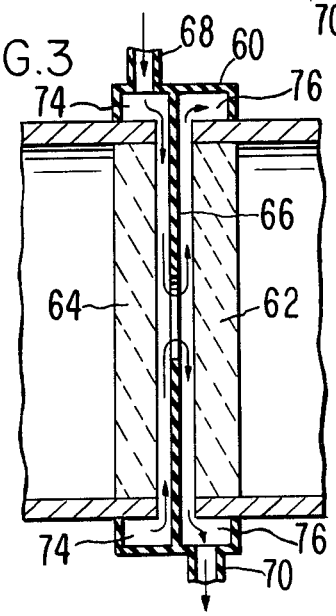
FIG. 3 is a cross-section of one embodiment of the present invention.

FIGS. 2 and 3 show two views of a preferred embodiment of the present invention. A cooling fluid, preferably a dielectric liquid, flows into the window assembly 60 through an inlet 68, as is shown by flow lines. The fluid first enters a first peripheral manifold 74 under pressure and is distributed around the periphery of the window assembly 60. The fluid is injected at a number of points from the first peripheral manifold 74 into the space between a first window plate 64 and a septum 66. The fluid then travels radially inward to a central aperture in the septum 66, through the aperture and then radially outward between the septum 66 and a second window plate 62. Finally, the fluid is collected by a second peripheral manifold 76 and is discharged through an outlet 70, where it may be directed to a cooling device (not shown) and thereafter recirculated back to the inlet 68.

Thus, the window assembly has two radial flow spaces, which may be designated the coolant input side of the window and the coolant output side of the window. On the input side of the window, the fluid flows radially inward, and on the output side, the flow is radially outward. Preferably, the input side of the window assembly should be positioned incident to the source of the microwaves as is shown in FIG. 1. This is preferable because the fluid temperature will be lowest on the input side and the input window plate is subject to the greatest thermal stress due to this initial incidence of microwaves. Moreover, in the application shown, the second window plate 62 is in contact with the atmosphere which provides some additional cooling.

The window plates 62 and 64 may be constructed of conventional dielectric materials used in prior art window assemblies, such as alumina, ceramic or sapphire. The septum should be made as thin as structurally possible to minimize the overall thickness of the assembly and energy losses across the window. It can be made of thin ceramic, Teflon® or any other suitable material.

It should be noted that the heating of the window assembly by incident microwave radiation is not uniform. For example, in gyrotrons, which produce a circular mode output, heating is concentrated in an annulus lying between the central and peripheral regions of the window. While thermal absorption is not a significant problem in the center or around the edge of the tube window, hot spots do occur in this annular region.

Heat transfer from a flat surface corresponds closely to the local velocity of the cooling fluid. Thus, effective heat removal requires high local fluid velocity. However, since increased fluid velocity causes a pressure drop proportional to the velocity squared times the flow distance, ideally velocity should only be increased in the areas subject to greatest heating. The foregoing window assembly 60 increases the cooling of the window in the annular region subject to the greatest heating by increasing the fluid velocity.

In the prior art liquid cooled window assembly, wherein a fluid is circulated betweenw two windows, there is no control of the localized flow patterns. Thus, the prior art windows do not provide additional cooling in the area where hot spots develop. While overall fluid velocity can be increased, the velocity increase is not directed in the areas where most needed.

It can be readily understood that, in the present invention, as the cooling liquid flows radially inward from the first peripheral manifold, the fluid velocity increases until the flow reaches the aperture. Conversely, after flowing through the aperture and reversing direction, the fluid velocity decreases as it flows radially outward toward the second peripheral manifold. Thus, the cooling is most efficient in the annular band where hot spots develop. The inner edge of the annular band where greatest cooling is provided may be controlled by the size of the central aperture.

Figure 4:
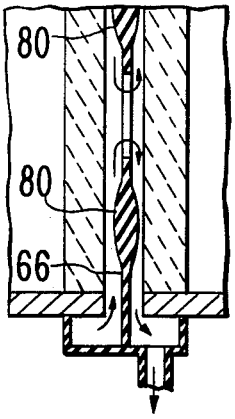
FIG. 4 is a cross-section of another embodiment of the present invention.

FIG. 4 shows a second embodiment of the present invention in which the septum is constructed to have an annular area of increased thickness 80. This is in contrast to the embodiment of FIGS. 1–3 in which the surface of the septum is flat. The increased thickness constricts the flow of the cooling fluid as it flows over the surface, thereby further increasing its localized velocity and cooling efficiency. The size, placement and thickness of the annular surface can be adjusted to provide the additional cooling where it is most needed.

Figure 5:
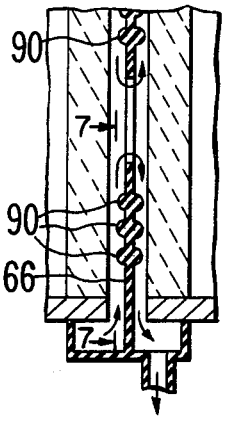
FIG. 5 is a cross-section of yet another embodiment of the present invention.
Figure 7:
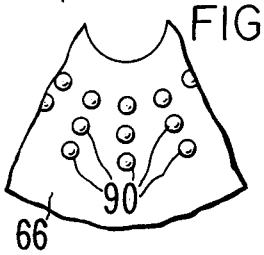
FIG. 7 is a cut-away view of the surface of the septum along view line 7 in FIG. 5.

Yet another embodiment of the present invention is shown in FIGS. 5 and 7. In this embodiment, the septum contains a plurality of raised bumps 90. These bumps 90 are shown in the form of hemispheres, but may take any desired shape. The bumps cause substantial turbulence in the cooling fluid as the fluid passes over them. This turbulence increases the localized fluid velocity and the local cooling efficiency.

Figure 6:
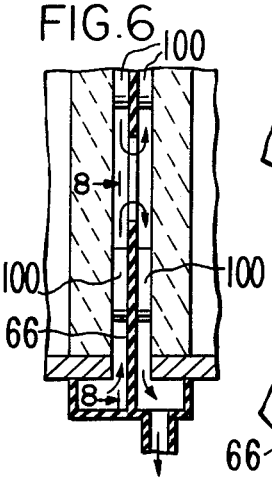
FIG. 6 is a cross-section of yet another embodiment of the present invention.
Figure 8:
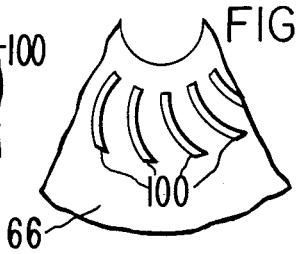
FIG. 8 is a cut-away view of the surface of the septum along view line 8 in FIG. 6.

Still another embodiment of the present invention is shown in FIGS. 6 and 8. In this embodiment, the surface of the septum contains a plurality of raised arcuate sections 100 arranged in an annular band between the central aperture and the periphery of the septum. Each arcuate section is curved in the same direction. In addition to increased localized fluid velocity caused by constricting the flow of the cooling fluid, the arcuate sections cause the fluid to have a rotational component of flow which has the effect of imparting additional velocity without increasing the net fluid transport. This rotational component also helps to maintain a uniform flow distribution.

The raised surface members on the septum shown in FIGS. 4, 5, 6, 7 and 8 have the further advantage of dampening any vibrational modes that might be induced by the high velocity fluid flow over the septum or through the aperture.

What is claimed is:

1. A microwave window assembly, comprising:

first and second dielectric window plates sealed generally parallel to each other across the open section of a waveguide means with a space therebetween;

a dielectric septum having a central aperture, said dielectric septum being mounted in the space between said dielectric window plates and parallel thereto;

means for circulating cooling fluid inwardly between said first dielectric window plate and said dielectric septum, then through said central aperture, and then outwardly between said second dielectric window plate and said dielectric septum.

2. A microwave window assembly as in claim 1, wherein said means for circulating cooling fluid comprises a peripheral input manifold and a peripheral output manifold.

3. A microwave window assembly as in claim 1, wherein said window plates and said dielectric septum are circular in cross-section.

4. A microwave window assembly as in claim 1, wherein said dielectric septum has one or more members disposed thereon which increase the flow velocity in the vicinity of said members.

5. A microwave window assembly as in claim 4, wherein said members comprise a plurality of bumps.

6. A microwave window assembly as in claim 5, wherein said bumps are hemispherical.

7. A microwave window assembly as in claim 4, wherein said member comprises an annular ring portion having a thickness greater than a mean thickness of said septum.

8. A microwave window assembly as in claim 1, further comprising means to impart rotational motion to the cooling fluid disposed on said septum.

9. A microwave window assembly as in claim 8, wherein said means to impart rotational motion comprise arcuate sections mounted on said septum in an annular band.

10. A microwave window assembly, comprising:

a first circular dielectric window plate sealed around the periphery across a waveguide means;

a second circular dielectric window plate, oriented generally parallel to said first dielectric window and closely spaced with respect to said first circular dielectric window plate, said second window plate also being sealed around the periphery across the waveguide means;

a circular dielectric septum having a central aperture, said circular dielectric septum being mounted between said first and said second window plates and parallel thereto;

a first circular manifold peripherally mounted around the perimeter of the space between said first window plate and said circular dielectric septum for injecting a dielectric cooling liquid between said first window plate and said septum;

inlet means for delivering said cooling fluid under pressure to said first circular manifold;

a second circular manifold peripherally mounted around the perimeter of the space between said second window plate and said circular dielectric septum for collecting said cooling liquid under pressure;

outlet means for receiving said cooling liquid from said second circular manifold;

whereby the cooling fluid enters the inlet means, flows under pressure into said first circular manifold, is injected into the space between said first window plate and said circular dielectric septum, accelerates toward said central aperture, flows through said aperture into the space between said second window plate and said septum, decelerates toward the periphery, is collected by said second circular manifold, flows through said outlet and is cooled and recirculated back to said inlet means whereupon the cycle is repeated.

11. A microwave window assembly as in claim 10, wherein said circular dielectric septum has a plurality of bumps on a surface of said septum.

12. A microwave window assembly as in claim 10, wherein said septum has a plurality of arcuate surfaces arranged in an annular pattern, whereby rotational motion is imparted to said cooling liquid.

13. A microwave window assembly as in claim 10, wherein said septum has an annular band portion having a thickness greater than a mean thickness of said septum.

14. A microwave window assembly as in claim 13, wherein said annular band portion on said circular dielectric septum is located in the region corresponding to the mode pattern of the electric field within said waveguide means.

* * * * *